US006088940A

United States Patent [19]

Golay

[11] Patent Number: 6,088,940

[45] Date of Patent: Jul. 18, 2000

[54] IRONING PRESS WITH MOVABLE IRONING BOARDS

[75] Inventor: Jean-Pierre Golay, Vers, France

[73] Assignee: Elna International Corp. S.A., Plan-les Ouates, Switzerland

[21] Appl. No.: 09/391,654

[22] Filed: Sep. 3, 1999

Related U.S. Application Data

[63] Continuation of application No. PCT/IB98/00257, Mar. 2, 1998.

[51] Int. Cl.[7] ..... D06F 71/28; D06F 81/12

[52] U.S. Cl. ..... 38/24; 38/36; 38/135

[58] Field of Search ..... 38/135, 139, 136, 38/20; 108/13, 17, 39, 59, 64, 65, 93; 223/72

[56] References Cited

U.S. PATENT DOCUMENTS

| | | | |
|---|---|---|---|
| 912,319 | 2/1909 | Nelson | 38/135 X |
| 2,888,759 | 6/1959 | Vennen | 38/135 |
| 5,014,453 | 5/1991 | Gratsch | 38/20 X |
| 5,452,530 | 9/1995 | Cartabbia | 38/20 X |

FOREIGN PATENT DOCUMENTS

| | | |
|---|---|---|
| 0 458 503 | 11/1991 | European Pat. Off. . |
| WO 87 07661A | 12/1987 | WIPO . |

*Primary Examiner*—Ismael Izaguirre
*Attorney, Agent, or Firm*—Henderson & Sturm LLP

[57] ABSTRACT

The invention concerns an ironing press including a base bearing an ironing plate, a sleeve board and an articulated arm for manoeuvring a heating plate, movable between two positions. In one position, the heating plate is pressed against the ironing plate or the sleeve board. The ironing plate and the sleeve board are mounted on the base so as to enable their alternating displacement from a working position to a retracted position. The ironing plate and the sleeve board are each articulated to the base and are interconnected by a linking member providing a kinematic linkage between them.

20 Claims, 2 Drawing Sheets

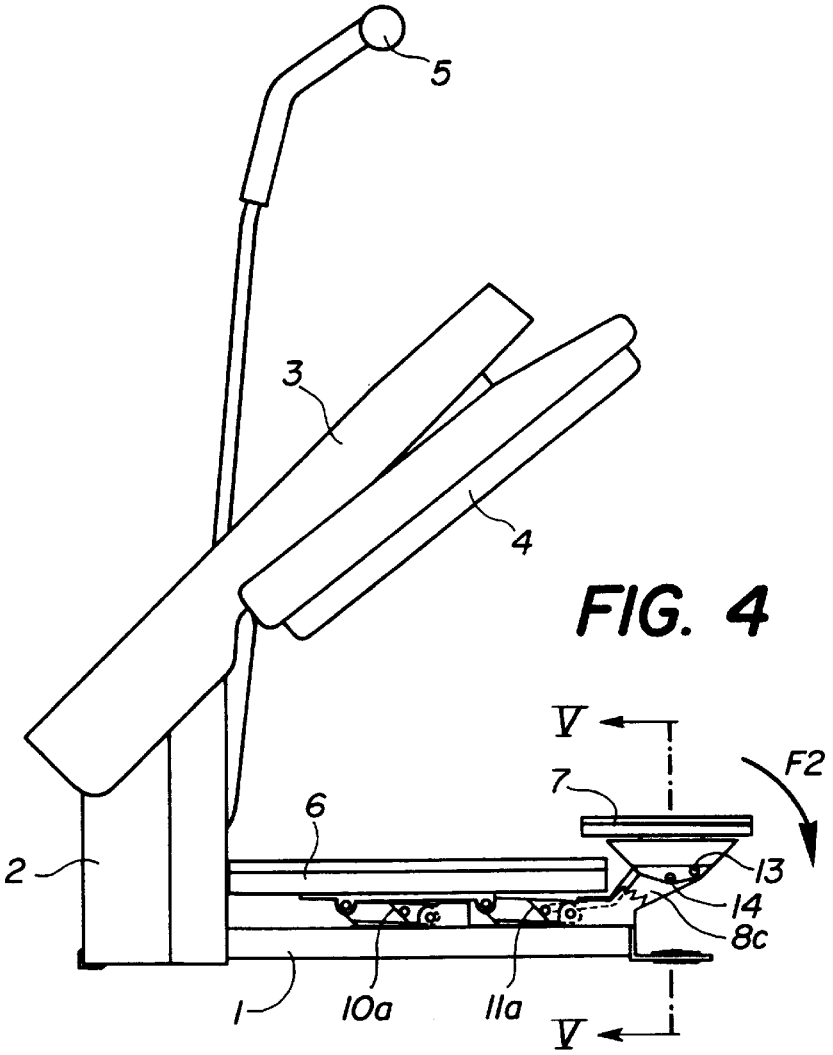
FIG. 4
FIG. 5
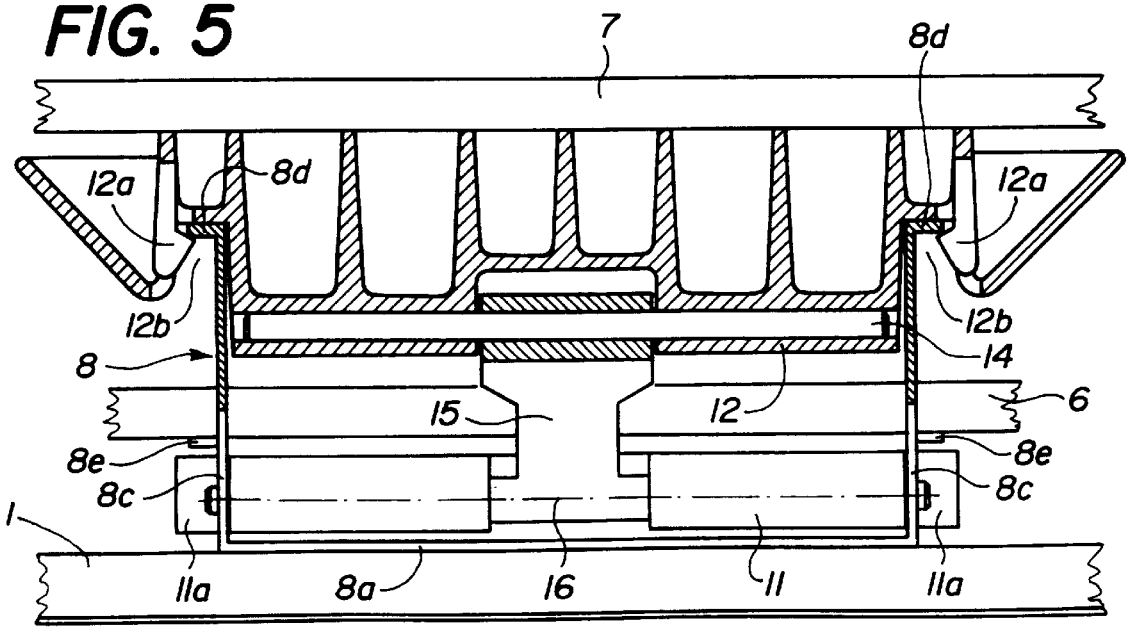

IRONING PRESS WITH MOVABLE IRONING BOARDS

CROSS-REFERENCE TO RELATED APPLICATIONS

This application is a continuation of PCT/IB98/00257 filed Mar. 2, 1998.

STATEMENT REGARDING FEDERALLY SPONSORED RESEARCH OR DEVELOPMENT

Not Applicable.

BACKGROUND OF THE INVENTION

1. Field of the Invention

The present invention relates to an ironing press, comprising a base bearing an ironing board, a sleeve-board and an articulated arm for manoeuvring a heating plate, movable between at least two positions, in one of which the said heating plate is pressed against the said ironing board or the said sleeve-board, this ironing board and this sleeve-board being mounted on the said base in a manner such as to allow their alternating mutual displacement from a working position to a retracted position and vice versa.

2. Description of the Prior Art

An ironing press of this type has already been described in CH-A-669 624. In this ironing press the sleeve-board is articulated on the base by a deformable parallelogram, while the ironing board comprises two pairs of rollers in engagement with guide grooves made in two parallel vertical walls of the base. This arrangement enables the sleeve-board and the ironing board to be displaced alternatively from a retracted position to a working position and vice versa. A fastening mechanism serves to lock the sleeve-board or the ironing board in its respective working position.

When the user wishes to change the ironing support in order to change over from the sleeve-board to the ironing board and vice versa, he has to unfasten the locking mechanism, move the ironing support in use from its working position to its retracted position and finally move the other ironing support from its retracted position to its working position. Even if these operations can be performed quickly, they have to be performed consecutively, which requires a certain amount of time. In the course of an ironing session, they are required to be repeated frequently, which ultimately constitutes a not insignificant loss of time.

From the manufacturing standpoint, the mechanism of this ironing press with its locking system possesses a considerable number of components to be assembled, which, apart from the manufacturing of these components, increases the assembly cost.

BRIEF SUMMARY OF THE INVENTION

The object of the present invention is to remedy, at least in part, the abovementioned disadvantages.

To this end, this invention relates to an ironing press of the abovementioned type, characterized in that the said ironing board and the said sleeve-board are each articulated, at least indirectly, on the said base and are connected to one another by a connecting member intended to establish a kinematic link between them.

This invention likewise relates to an ironing press comprising the features set out in the dependent claims.

The advantages of the ironing press according to this invention are firstly of a practical nature, since the use of this press is simplified, it being possible to achieve the change of ironing support with one hand and in a single operation by causing the sleeve-board to pivot about its pivot pin, both in order to retract it and in order to bring it into its working position. Now, the sleeve-board being by definition narrower than the ironing board, it is easy to grasp it in one hand and then cause it to swing between its two positions.

The other advantage is that of allowing a significant reduction in the number of components and hence in the cost both of manufacture and of assembly. Now, as will have been apparent from the preceding explanations, the simplification of the press makes it possible at the same time to facilitate its use, without impairing the reliability of the product, a simple apparatus being, on the contrary, less likely in principle to undergo deterioration in the course of use.

Other advantages will become apparent from the description which follows, given in relation to the attached drawing which illustrates, diagrammatically and by way of example, a form of embodiment of the ironing press which is the subject of the present invention.

BRIEF DESCRIPTION OF THE SEVERAL VIEWS OF THE DRAWINGS

FIG. 4 is a view in lateral elevation similar to FIG. 3, but showing the press open;

FIG. 5 is a view partially in section along the line V—V in FIG. 4.

DETAILED DESCRIPTION OF THE INVENTION

Figure 1:
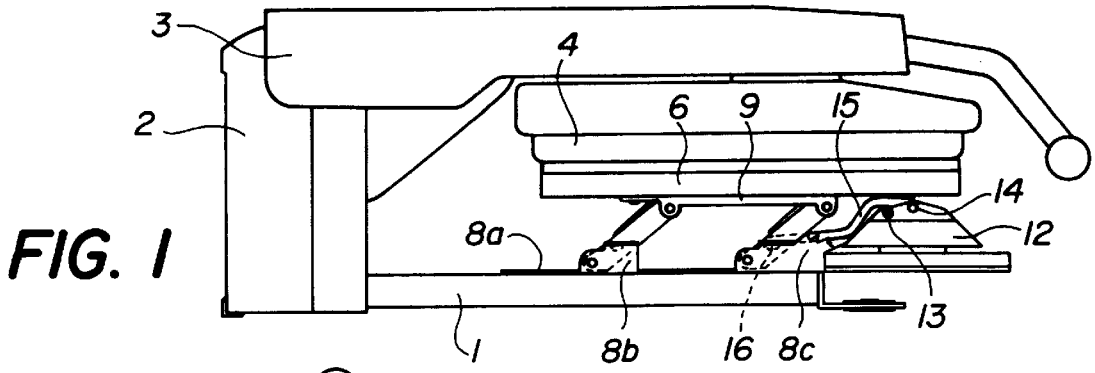
FIG. 1 is a view in lateral elevation of this form of embodiment in a first working position.

The ironing press illustrated possesses a base 1 solidly fixed to a vertical member 2 on which an arm 3 is articulated. This arm bears a heating plate 4 and an operating handle 5 serving to lock the heating plate against one of the ironing supports, ironing board 6 or sleeve-board 7, maintaining a certain pressure between them, in order to iron the piece of fabric placed on the ironing board 6 or on the sleeve-board 7.

Given that the present invention relates to the mechanism enabling the ironing support to be changed in the course of an ironing session and that the mechanismn for actuating the arm is of a known type and is not necessary to the understanding of the present invention, no further details will be given regarding the structure of this arm 3 and its mode of actuation.

Figure 2:
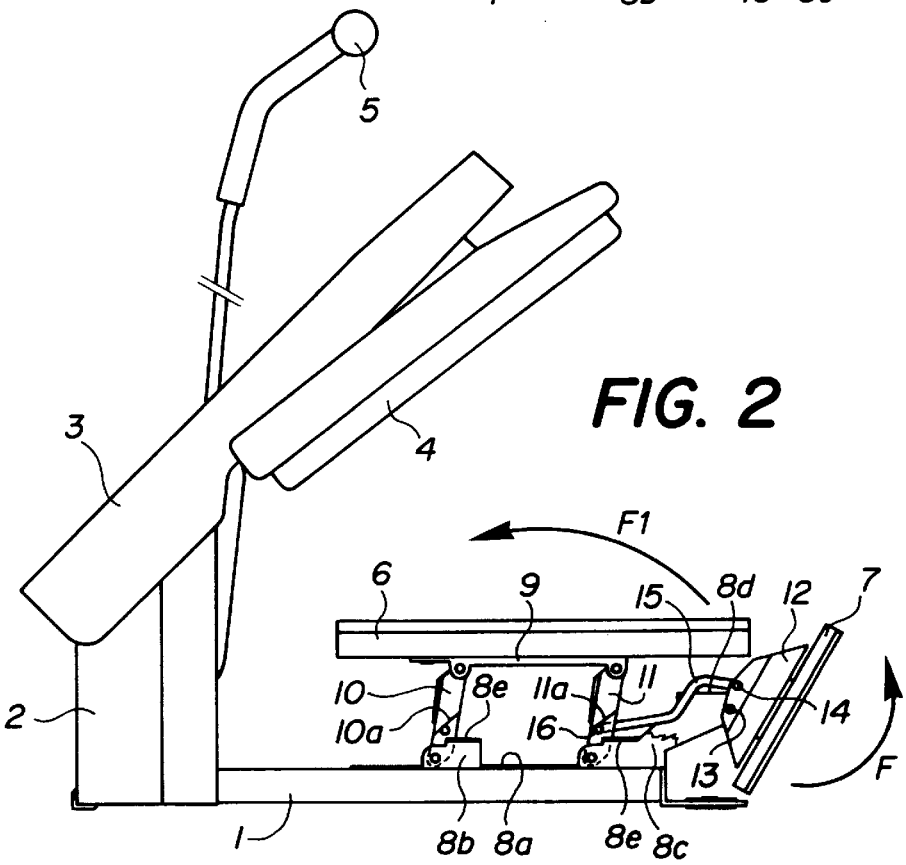
FIG. 2 is a view in lateral elevation of the open press, during the change of ironing support.

As can be seen in particular in FIGS. 2 and 5, a support 8 is fixed on the base 1. This support 8 is formed by a base plate 8*a* of rectangular general shape having on each side lateral edges 8*b*, 8*c* bent back vertically upwards from this base plate 8*a*. The horizontal upper ends of these vertical lateral edges 8*b*, 8*c* are themselves bent back at 90° outwards, to form stops elements 8*e* and hooking elements 8*d* extending horizontally, whose function will be explained in due course.

The lower surface of the ironing board 6 bears a plate having lateral edges bent back downwards at a right angle 9. The vertical lateral edges 8*b*, 8*c* of the support 8 and those of the plate 9 are pierced by apertures, aligned in pairs between opposing edges, parallel to the respective planes of the plates 8*a* and 9, for the articulation of two parallel surfaces 10, 11 of a deformable rectangular parallelepiped, formed from pieces of injection-moulded plastic, whose other two surfaces are constituted, respectively, by the rectangular plate 8*a* of the support 8 solidly fixed to the base and by the plate 9 solidly fixed to the ironing board 6. Each lateral edge of the surfaces 10 and 11 exhibits a break in continuity, defined by an oblique plane, 10*a* and 11*a* respectively (FIGS. 2 to 4), projecting outwards from the bent-back edges 8*b*, 8*c* of the support (FIG. 5). As can be seen in FIG. 1, these projecting breaks in continuity defined by these oblique planes serve to bear on the stop elements 8*e* of the bent-back edges 8*b* and 8*c* and to ensure the positioning and support of the ironing board 6.

The sleeve-board 7 is fixed on a seating 12 of injection-moulded plastic. This seating 12 is mounted to pivot about a pivot pin 13 whose ends penetrate into two opposing apertures passing through the two vertical edges 8*c* of the support 8. This seating 12 is also articulated by a second pin 14, parallel to the pin 13, on one end of a transmission arm 15, whose other end is articulated about a pin 16, parallel to the pins 13 and 14, situated along the plane 11 of the deformable parallelepiped.

By virtue of this transmission arm 15 a kinematic link is established between the ironing board 6 and the sleeve-board 7.

The seating 12 of the sleeve-board 7 is injection moulded with two hooking elements 12*a* (FIG. 5). As can be seen in this figure, these hooking elements project into two hollowed-out parts 12*b* of the seating 12, each intended to receive one of the vertical edges 8*c* of the support 8. The part of the hooking element 12*a* which penetrates into the hollowed-out part 12*b* possesses two planes inclined in opposite directions. On engaging into these hollows 12*b* of the seating 12, the rims 8*d*, formed at the upper ends of the vertical edges 8*c*, encounter one of the inclined planes of the hooking member 12*a*, so that the pressure exercised by rotation, manually communicated to the sleeve-board 7, about its pivot pin 13, causes the hooking member 12*a* to move away. When the rim 8*d* abuts against the bottom of the hollow 12*b* of the support 12, it has passed the ridge between the inclined planes of the hooking member 12*a* and is in contact with the other inclined plane, which thus tends to retain this rim 8*d* in the hollow 12*b*. When a force is exerted on the sleeve-board 7 to make it turn in the direction of the arrow F2 (FIG. 4) and disengage it from the rim 8*d*, the inclined surface of the hooking member 12*a* retaining the seating 12 on this rim 8*d* enables this hooking element 12*a* to be moved away and the seating 12 to be disengaged from this rim 8*d*.

Given that the seating 12 of the sleeve-board is connected to the deformable parallelepiped 8, 9, 10, 11, on which the ironing board 6 is fixed, by the transmission arm 15, the displacement of the sleeve-board 7 about its pivot pin 13 is translated into a deformation of this deformable parallelepiped 8, 9, 10, 11, the three surfaces 9, 10, 11 moving relative to the fourth surface 8*a*, solidly fixed to the base 1.

FIG. 1 shows the ironing press in the closed position, that is to say when the heating plate 4 is applied against the ironing board 6 by the arm 3. In this position, the oblique planes 10*a*, 11*a* defining the breaks in continuity of the surfaces 10 and 11, respectively, of the deformable parallelepiped which project laterally outwards from the vertical edges 8*c* of the support 8 rest on the horizontal stops 8*e* which are bent back outwards and formed on the vertical lateral sides 8*c*. These stops 8*e*, numbering four, ensure a stable position of the ironing board 6.

FIG. 2 shows the ironing press open during the change of ironing surface. It can in fact be seen that the sleeve-board 7 is displaced angularly about its pivot pin 13 in the direction of the arrow F. This movement of the sleeve-board 7 is transmitted to the deformable parallelepiped 8, 9, 10, 11 by the transmission arm 15, so that the ironing board 6, solidly fixed to the surface 9 of this deformable parallelepiped, moves in translation in the direction of the arrow F1.

Figure 3:
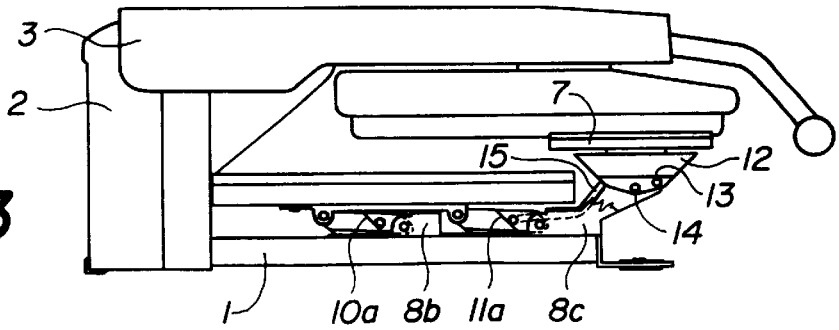
FIG. 3 is a view in lateral elevation of this press in its second working position.

FIGS. 3 and 4 illustrate the end of this movement, in one case with the ironing press open and in the other case with this press closed. At the end of the travel, the hooking elements 12*a* of the seating 12 of the sleeve-board 7 encounter the rims 8*d* of the support 8 on which rims this seating 12 is hooked, as explained above, ensuring a stable fixed position of the sleeve-board 7 in the working position. As can be seen in particular in FIG. 2, the rims 8*d* are of a certain length, suitable for ensuring the stable horizontal positioning of the sleeve-board in the working position. As can be verified, both the hooking elements 12*a* and the rims 8*d* are made integrally with the seating 12 and the support 8, respectively, in a manner such that this locking mechanism requires no particular member to be operated by the user, a pressure or traction on the sleeve-board 7 enabling locking and unlocking, respectively, of the seating 12 to and from the support 8 to be achieved. This simplification of use is likewise reflected in a reduction of the production cost.

In fact, as has been mentioned previously, the seating 12 of the sleeve-board 7 and the surfaces 10 and 11 of the deformable parallelepiped are of injection-moulded plastic, enabling the locking mechanism to be integrated into the seating 12. Moreover, the transmission arm 15 is also preferably of injection-moulded plastic, while the support 8 is a die-stamped piece, so that the machining operations of the few existing pieces are reduced to the minimum. The strength of the mechanism described can also be emphasized, guaranteeing, together with the simplicity of this mechanism, reliable and durable operation. It may also be seen that the simplicity of operation excludes any foreseeable deterioration caused by possible incorrect handling.

What is claimed is:

1. An ironing press, comprising a base bearing an ironing board, a sleeve-board and an articulated arm for manoeuvring a heating plate, movable between at least two positions, in one of said positions said heating plate is pressed against said ironing board or said sleeve-board, the ironing board or said sleeve-board being mounted on said base in a manner such as to allow their alternating mutual displacement from a working position to a retracted position and vice versa, wherein said ironing board and said sleeve-board are each articulated, at least indirectly, on said base and are connected to one another by a connecting member intended to establish a kinematic link between them.

2. The ironing press according to claim 1, wherein said sleeve-board is articulated on said base about a pivot pin, while said ironing board is articulated on two respective edges of two opposing faces of a deformable rectangular parallelepiped, whose two respective opposing edges are articulated on said base, the axes of articulation of this deformable parallelepiped being parallel to the pivot pin of said sleeve-board, said connecting member being articulated on the one hand on one of the sides of said deformable parallelepiped and on the other hand on a pin solidly fixed to said sleeve-board, parallel to its pivot pin.

3. The ironing press according to claim 2, wherein said sleeve-board comprises resilient hooking means capable of becoming deformed resiliently to enter into engagement, with hooking and positioning means solidly fixed to said base, consecutively to a pressure exercised upon them, when said sleeve-board is brought into its working position and to disengage therefrom when it is retracted.

4. The ironing press according to claim 3, wherein means for the articulation of the sleeve-board on said base and on said connecting member, respectively, on the one hand and said resilient hooking means for fixing said sleeve-board solidly to said base in the working position on the other hand are made integrally with a seating to which said sleeve-board is fixed.

5. The ironing press according to claim 4, wherein said seating is a piece of injection-moulded plastic.

6. The ironing press according to claim 2, wherein a support member, solidly fixed to said base, possesses a base plate made integrally with vertical lateral edges situated on either side of this base plate and possessing on the one hand pivot means for the articulation of said ironing board and of said sleeve-board and on the other hand said stops for positioning of said ironing board in the working position, together with said hooking means for positioning said sleeve-board in the working position.

7. The ironing press according to claim 2, wherein said sleeve-board performs an angular displacement of substantially 180° between its two positions, working and retracted.

8. The ironing press according to claim 1, wherein stops are solidly fixed to said base and are disposed in the trajectory of stops solidly fixed to the two opposing movable faces of said deformable parallelepiped, to restrict their angular displacement once said ironing board has arrived in its working position.

9. The ironing press according to claim 8, wherein said sleeve-board comprises resilient hooking means capable of becoming deformed resiliently to enter into engagement, with hooking and positioning means solidly fixed to said base, consecutively to a pressure exercised upon them, when said sleeve-board is brought into its working position and to disengage therefrom when it is retracted.

10. The ironing press according to claim 9, wherein means for the articulation of the sleeve-board on said base and on said connecting member, respectively, on the one hand and said resilient hooking means for fixing said sleeve-board solidly to said base in the working position on the other hand are made integrally with a seating to which said sleeve-board is fixed.

11. The ironing press according to claim 10, wherein said seating is a piece of injection-moulded plastic.

12. The ironing press according to claim 8, wherein a support member, solidly fixed to said base, possesses a base plate made integrally with vertical lateral edges situated on either side of this base plate and possessing on the one hand pivot means for the articulation of said ironing board and of said sleeve-board and on the other hand said stops for positioning of said ironing board in the working position, together with said hooking means for positioning said sleeve-board in the working position.

13. The ironing press according to claim 1, wherein said sleeve-board comprises resilient hooking means capable of becoming deformed resiliently to enter into engagement, with hooking and positioning means solidly fixed to said base, consecutively to a pressure exercised upon them, when said sleeve-board is brought into its working position and to disengage therefrom when it is retracted.

14. The ironing press according to claim 13, wherein a support member, solidly fixed to said base, possesses a base plate made integrally with vertical lateral edges situated on either side of this base plate and possessing on the one hand pivot means for the articulation of said ironing board and of said sleeve-board and on the other hand said stops for positioning of said ironing board in the working position, together with said hooking means for positioning said sleeve-board in the working position.

15. The ironing press according to claim 13, wherein means for the articulation of the sleeve-board on said base and on said connecting member, respectively, on the one hand and said resilient hooking means for fixing said sleeve-board solidly to said base in the working position on the other hand are made integrally with a seating to which said sleeve-board is fixed.

16. The ironing press according to claim 15, wherein said seating is a piece of injection-moulded plastic.

17. The ironing press according to claim 15, wherein a support member, solidly fixed to said base, possesses a base plate made integrally with vertical lateral edges situated on either side of this base plate and possessing on the one hand pivot means for the articulation of said ironing board and of said sleeve-board and on the other hand said stops for positioning of said ironing board in the working position, together with said hooking means for positioning said sleeve-board in the working position.

18. The ironing press according to claim 1, wherein a support member, solidly fixed to said base, possesses a base plate made integrally with vertical lateral edges situated on either side of this base plate and possessing on the one hand pivot means for the articulation of said ironing board and of said sleeve-board and on the other hand said stops for positioning of said ironing board in the working position, together with said hooking means for positioning said sleeve-board in the working position.

19. The ironing press according to claim 1, wherein said sleeve-board performs an angular displacement of substantially 180° between its two positions, working and retracted.

20. The ironing press according to claim 1, wherein stops are solidly fixed to said base and are disposed in the trajectory of stops solidly fixed to the two opposing movable faces of said deformable parallelepiped, to restrict their angular displacement once said ironing board has arrived in its working position.

* * * * *